United States Patent [19]

Goldstein et al.

[11] Patent Number: 4,974,487

[45] Date of Patent: Dec. 4, 1990

[54] PLASMA PROPULSION APPARATUS AND METHOD

[75] Inventors: Yeshayahu S. A. Goldstein, Gaithersburg; Derek A. Tidman, Silver Spring, both of Md.; Rodney L. Burton, Fairfax Station, Va.; Dennis W. Massey, Manassas, Va.; Niels K. Winsor, Alexandria, Va.

[73] Assignee: GT-Devices, Alexandria, Va.

[21] Appl. No.: 252,551

[22] Filed: Oct. 3, 1988

Related U.S. Application Data

[63] Continuation of Ser. No. 809,071, Dec. 13, 1985, abandoned, which is a continuation of Ser. No. 657,888, Oct. 5, 1984, Pat. No. 4,715,261.

[51] Int. Cl.[5] ..... F41F 1/04

[52] U.S. Cl. ..... 89/7; 89/8; 124/3; 219/121.36; 219/121.59; 313/231.31; 315/111.31

[58] Field of Search ..... 60/202, 203.1; 89/7, 89/8; 102/202, 291, 403; 124/3; 219/121.36, 121.48, 121.5, 121.52, 121.53, 121.59; 313/231.31, 231.41, 231.51, 362.1; 315/111.21, 111.31, 111.41, 111.51, 111.61, 111.71, 111.81; 376/105, 107, 144, 145, 150

[56] References Cited

U.S. PATENT DOCUMENTS

| | | | |
|---|---|---|---|
| 671,708 | 4/1901 | Noble | 102/435 |
| 692,819 | 2/1902 | Bissell | 89/8 |
| 1,358,296 | 11/1920 | Csanyi | 89/7 |
| 2,072,671 | 3/1937 | Foulke | 102/448 |
| 2,790,354 | 4/1957 | Yoler et al. | 89/8 |
| 2,804,804 | 9/1957 | Cumming | 89/1 |
| 2,986,072 | 5/1961 | Hudson | 89/7 |
| 3,313,208 | 4/1967 | Dorsey et al. | 89/7 |
| 3,465,639 | 9/1969 | Cooley | 89/8 |
| 3,491,690 | 1/1970 | Knight | 102/448 |
| 3,916,761 | 11/1975 | Fletcher et al. | 89/8 |
| 3,929,119 | 12/1975 | Fletcher et al. | 89/8 |
| 3,939,816 | 2/1976 | Espy | 376/105 X |
| 3,985,866 | 10/1976 | Oda et al. | 423/657 |
| 4,024,793 | 5/1977 | Larrison et al. | 89/135 |
| 4,034,497 | 7/1977 | Yanda | 42/1 G |
| 4,343,223 | 8/1982 | Hawke et al. | 89/8 |
| 4,429,612 | 2/1984 | Tidman et al. | 89/8 |
| 4,590,842 | 5/1986 | Goldstein et al. | 89/8 |
| 4,640,180 | 2/1987 | Rose | 89/8 |
| 4,711,154 | 12/1987 | Chryssomallis et al. | 89/7 |
| 4,715,261 | 12/1987 | Goldstein et al. | 89/8 |

FOREIGN PATENT DOCUMENTS

| | | | |
|---|---|---|---|
| 3319998 | 2/1984 | Fed. Rep. of Germany | 89/8 |
| 2125527 | 3/1984 | United Kingdom | 89/8 |

OTHER PUBLICATIONS

Kaye, Seymour M., Encyclopedia of Explosives and Related Items, PATR 2700, vol. 8, 1978, "Plasma" pp. 307–310.

*Primary Examiner*—Stephen C. Bentley

*Attorney, Agent, or Firm*—Lowe, Price, LeBlanc, Becker & Shur

[57] ABSTRACT

A projectile is accelerated in a barrel bore by applying a plasma jet to a projectile propelling fluid. The plasma jet is derived from a structure forming a capillary passage having a wall formed by a low molecular weight, dielectric powdery filler or water in many rigid containers, shaped as spheres or straw-like tubes having axes parallel to the passage longitudinal axis. The fluid and jet interact so the fluid is heated by the jet, whereby low atomic weight constituents of the fluid are sufficiently heated to become mixed with the plasma to form a high pressure mixture that is injected into the bore to accelerate the projectile. The fluid is dragged into the plasma during mixing to cool the plasma and form a boundary layer between the plasma and the barrel walls so that the mixture does not cause substantial damage to the walls of the bore. The plasma is energized by applying voltage from an electric pulse source to electrodes at opposite ends of the passage. The pulse has a wave shape and duration for initially igniting the plasma source and for thereafter applying energy to the ignited plasma to control the pressure of the mixture. Initially, the fluid cools the plasma without the mixture developing sufficient pressure to accelerate the projectile appreciably. The wave shape and duration are such that the pressure applied to the projectile remains substantially constant while the projectile is being accelerated through the barrel, as occurs during about one-half of the projectile travel time in the barrel.

48 Claims, 3 Drawing Sheets

PLASMA PROPULSION APPARATUS AND METHOD

This application is a continuation of application Ser. No. 809,071, filed Dec. 13, 1985, now abandoned.

FIELD OF THE INVENTION

The present invention relates generally to an apparatus for and method of accelerating a projectile and more particularly to a projectile accelerating method and apparatus wherein an electric pulse source for energizing the plasma has a waveshape and duration for initially igniting the plasma and for thereafter applying energy to the ignited plasma to control the pressure of a propelling agent derived in response to the plasma. In accordance with a further aspect of the invention, a confined mass of projectile propelling fluid mixes with the plasma to cool the plasma initially and is subsequently heated by the plasma so low atomic weight constituents thereof become sufficiently energetic to accelerate the projectile in a bore of a barrel in which the projectile is located. In accordance with another aspect of the invention the plasma is derived from an ablatable, low atomic weight dielectric granular filler or a liquid containing low atomic weight elements located in many large surface area dielectric containers, e.g., spheres or long thin tubes, which together form a capillary discharge. In accordance with an additional object of the invention, the dielectric containers have differing wall thicknesses to control the time when the contents thereof are ignited.

BACKGROUND ART

The present application is a continuation in part of the co-pending commonly assigned application Ser. No. 657,888, filed Oct. 5, 1984, now U.S. Pat. No. 4,715,261.

It has long been recognized by designers of systems employing chemical explosives for accelerating a projectile through a barrel bore that it is desirable for the pressure acting on the projectile and within the barrel to remain substantially constant while the projectile is accelerated through the bore. The constant pressure is desirable because it provides constant acceleration for a relatively prolonged time interval to the projectile, to increase the total energy applied to the projectile at the time the projectile leaves the barrel muzzle. The constant pressure in the bore also enables the bore strength to be reduced relative to the situation of a pulsed propulsive force. This is because the pulse must have a higher initial force to achieve a muzzle velocity which is attained with a constant pressure source.

Obtaining a constant barrel pressure, however, is difficult because of the constantly increasing volume in the barrel, behind the projectile. Because of the constantly increasing barrel volume, constant pressure can be achieved by adding additional gaseous material to the barrel, as the projectile is being accelerated, or by heating the material in the barrel so that the material becomes more energetic as the projectile is being accelerated through the barrel. The impulsive nature of chemical explosions, however, does not enable either of those results to be achieved. Thus, despite many efforts, chemical explosive devices have been unable to achieve the desirable result of a constant pressure in a barrel, acting on a projectile. A further disadvantage of chemically driven projectile devices is that they are efficient, reliable devices for projectile velocities only below about 1.5 kilometers per second. Because chemical propellants are generally high density exothermic compounds producing two phase mixtures, sound speed limitations thereof cause a rapid decline in energy conversion efficiency for projectile velocities above about 1.5 kilometers per second. In the hypervelocity range, above 1.5 kilometers per second, it is desirable to use other energy sources to conveniently heat packaged low atomic weight propellants inside of a gun.

We have now realized that electrically controlled hypervelocity (more than 1.5 kilometers per second) plasma propulsive systems are capable of providing the desired result of constant pressure acting on a projectile being accelerated through a bore. Electrical sources to energize plasma jets to achieve hypervelocity projectiles are disclosed in the copending, commonly assigned application of Goldstein et al, Ser. No. 471,215, filed Mar. 1, 1983, now U.S. Pat. No. 4,590,842, and our copending application entitled Cartridge Containing Plasma Source for Accelerating a Projectile, Lowe, King, Price & Becker Docket 277-004, Ser. No. 657,888 filed Oct. 5, 1984, now U.S. Pat No. 4,715,261. In the '215 application, a projectile is accelerated along a bore by plural plasma jet sources, located at different longitudinal positions along the length of the bore. The jet sources have an oblique angle with respect to the bore. In our copending application, a projectile is accelerated from a gun having a barrel with a bore adapted to receive the projectile and a breech block having a bore aligned with the barrel bore. A cartridge in the breech block bore responds to an electric source to supply a high temperature, high pressure plasma jet to the rear of the projectile in the bore.

In both of the aforementioned inventions, the plasma jet source includes a tube having an interior wall forming a capillary passage, i.e., a passage having a length to diameter ratio of at least 10:1. A discharge voltage is supplied by a suitable source between spaced regions along the length of the interior wall while a dielectric ionizable substance is between the regions. The dielectric ionizable substance includes at least one element that is ionized to form a plasma in response to the discharge voltage being applied between the spaced regions. The passage has a diametric length that is short relative to the distance between the spaced regions to form the capillary passage. First and second ends of the passage are respectively opened and blocked to enable and prevent the flow of plasma through them. The plasma forms an electric discharge channel between the spaced regions. Ohmic dissipation occurs in the electric discharge channel to produce a high pressure in the passage to cause the plasma in the passage to flow longitudinally in the passage through the first, i.e., open, end to form the plasma jet which accelerates the projectile through the bore.

THE INVENTION

We have now discovered that the electric source preferably has a waveform and duration such that the pressure supplied by the plasma jet to the barrel bore enables the pressure within the barrel bore and acting on the projectile to be accurately controlled. In particular, the pressure acting on the rear of the projectile and, to a large extent within the barrel bore, is controlled so that it is substantially constant while the projectile is being accelerated during the electrical pulse, which has a duration of about one-half of the travel time of the projectile through the barrel bore. Thus, the plasma pressure acting on the rear of the projectile remains substantially constant during the time the electrical pulse is being generated. This is in contrast to the typical chemically driven projectiles wherein there is an initial very large pressure applied to the rear of the projectile; as the volume within the barrel bore increases as the projectile approaches the barrel muzzle, the pressure acting on the rear of the projectile decreases to a very substantial extent and never increases.

In the present invention, the pressure is prevented from falling while the projectile is in the bore by increasing the power-density applied to the plasma between a pair of fixed points along the bore axis as the projectile is accelerated in the bore. To maintain the pressure constant, the electric power density applied to the plasma increases approximately linearly with time as the projectile is accelerated in the bore. To this end, the square of the current fed by the electric supply to the plasma increases in an approximately linearly manner as a function of time. The electric source applies a potential across the dielectric via an electrode at each of the fixed points in the capillary passage to heat the dielectric so that the amount of plasma from the dielectric injected from the passage into the bore increases as the projectile is accelerated in the bore.

It is, accordingly, an object of the present invention to provide a new and improved apparatus for and method of enabling a gun to accelerate projectiles efficiently to a very high speed.

A further object of the invention is to provide a new and improved apparatus for and method of accelerating a projectile in a bore by using a plasma source that is controlled in such a manner as to provide a predetermined time varying pressure against the projectile while it is in a barrel bore.

A further object of the invention is to provide a new and improved apparatus for and method of accelerating a projectile through a bore so that pressure acting on the rear of the projectile remains substantially constant while the projectile is in the bore.

Still a further object of the invention is to provide a new and improved apparatus for and method of accelerating a projectile wherein a barrel through which the projectile is accelerated can be designed to withstand lower forces than with chemically driven forces, even though the projectile is driven to hypervelocity that cannot be achieved by chemical explosives.

In experimenting with the structure disclosed in our previously mentioned, copending applications, we found that there was occasionally a tendency for excessive heat to be generated in the barrel. The very high temperatures of the jet have a tendency to adversely affect the walls of the barrel bore. The amount of the heating has been found to be a function of pulse length, such that long pulses produce more heat than short pulses. However, the long pulses are frequently desirable because they enable greater energy to be delivered to the projectile.

We have now discovered that this long pulse can be used without heating the barrel excessively by providing a confined mass of projectile propelling fluid having a low atomic weight constituent between a nozzle for injecting the jet into the barrel and a location in the barrel where the projectile is located. The plasma is energized by the electric source so that the plasma initially projected through the nozzle into the projectile propelling fluid mixes with the fluid to cool the plasma and heat the fluid. The fluid is dragged into the plasma when they are mixed to cool the plasma sufficiently to prevent substantial damage to walls of the bore. Subsequently, the plasma injected into the fluid heats the fluid sufficiently so the low atomic weight constituent of the fluid enters a highly energetic gaseous state having a high sound speed to accelerate the projectile through the barrel. Because the plasma energy is controlled by the electric source, the waveshape of the electric source can easily control the amount of heating of the fluid by the plasma jet during the initial and subsequent stages of operation. The geometries of the barrel, a chamber for the fluid, and a nozzle for injecting the plasma from the capillary into the chamber and barrel are such that a boundary layer is established between the fluid and the plasma. The boundary layer prevents the plasma from contacting the barrel wall, whereby the barrel is not heated excessively by the plasma.

The plasma is controlled so it is initially mixed with the fluid to cool the plasma with the mixture developing sufficient initial pressure close to the constant pressure which is applied to the projectile while the projectile is accelerated to high speed, as occurs when the main pulse is generated to accelerate the pressure. The initial mixing occurs for a time period sufficiently long to accelerate the projectile from rest and increase the volume in the bore. Then, the power applied to the plasma increases during the main pulse, during continued mixing between the plasma and fluid, to form the high pressure mixture which propels the projectile to hypervelocities by acting on the rear thereof.

It is, accordingly, a further object of the invention to provide a new and improved apparatus for and method of preventing excessive heating of a barrel bore wall even though propulsive forces for driving a projectile through the bore are derived by a plasma source.

An additional object of the invention is to provide a new and improved apparatus for and method of accelerating a projectile in a bore to hypervelocities by using a plasma source that is controlled in such a manner as to prevent damage to a barrel through which the projectile is being accelerated by gases resulting from derivation of the plasma.

An additional object of the invention is to provide a new and improved projectile propulsion system and method wherein a controlled source causes a plasma jet to interact with a fluid which prevents excessive heating of a barrel by plasma and wherein the same source applies additional energy to the plasma to cause the projectile to be accelerated through the barrel.

We have also found that the capillary passage in which the plasma is formed is advantageously formed as an elongated structure having a hollow center containing many large surface area containers for an ablatable, low atomic weight dielectric powder-like or granular filler or a liquid containing low atomic weight elements, e.g., hydrogen and oxygen. The large surface area containers are preferably formed as elongated straw-like tubes or small spheres. The filled straw-like containers cause the electric resistance between electrodes at opposite ends of the capillary to increase during the plasma discharge, which decreases the output current and power requirements of a power supply for deriving the plasma. The large surface area and increased resistance decrease the length to diameter ratio requirements of the capillary passage between the electrodes from a ratio of about 30:1 to about 10:1. The lower current requirement reduces the temperature of the plasma jet exiting the capillary to assist maintaining the temperatures in a mixing chamber containing the cooling liquid and the barrel bore wall at a lower level. To assist in shaping the derivation of plasma derived from the capillary as a function of time, different ones of the containers have differing wall thicknesses and are appropriately positioned in the capillary passage. The contents of thick walled containers are ignited after the contents of thin walled containers. Typically the thick walled containers are upstream in the capillary of the thin walled containers (i.e., the thick walled containers are farther from the barrel than the thin wall containers) so that the contents thereof are ignited and contribute to the plasma formation after the thin walled container contents. The thin walled containers preferably contain a liquid that forms a plasma boundary layer on the barrel wall to cool the wall as the high temperature plasma from solid grains in the thick wall containers propagates through the barrel.

It is therefore a further object of the present invention to provide a new and improved capillary passage structure for deriving a plasma jet.

It is still another object of the invention to provide a new and improved plasma jet deriving capillary passage structure having an increased electric resistance to current from a power supply so that the size and weight of the power supply can be reduced.

It is an additional object of the invention to provide a new and improved plasma jet deriving capillary passage structure having smaller dimensional and weight requirements than prior art structures.

It is still a further object of the invention to provide a new and improved plasma jet deriving capillary passage structure which produces a jet having lower temperature than prior art structures.

The above and still further objects, features and advantages of the present invention will become apparent upon consideration of the following detailed description of several specific embodiments thereof, especially when taken in conjunction with the accompanying drawings.

BEST MODE FOR CARRYING OUT THE INVENTION

Figure 1:
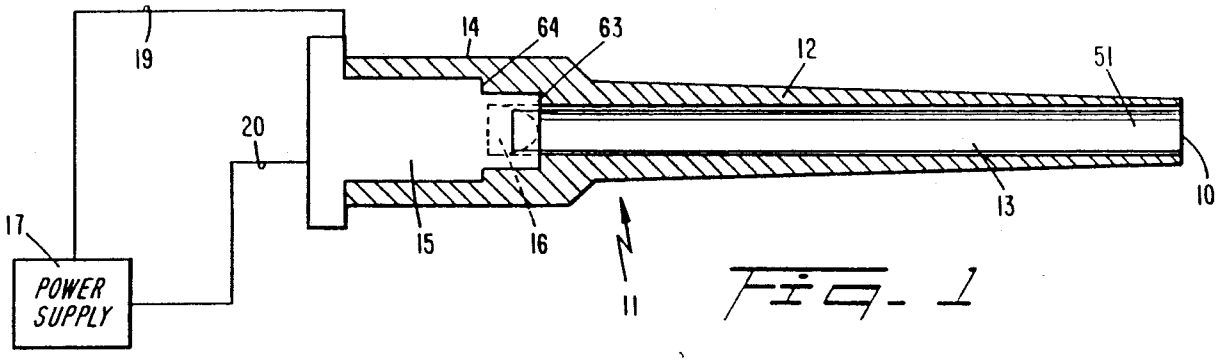
FIG. 1 is a schematic diagram of a cartridge loaded into a breech bore of a gun, in combination with a power supply, in accordance with a preferred embodiment of the present invention.

Reference is now made to FIG. 1 of the drawing wherein gun 11 is illustrated as including elongated barrel 12, containing rifled or smooth bore 13 that ends at muzzle 10. Gun 11 includes a breech 14 where cartridge 15 is loaded. Cartridge 15 contains projectile 16 that can be shaped as a bullet or have some other suitable shape, e.g., a sphere. High voltage power supply 17 selectively supplies high voltage, high current electric pulses having a predetermined waveshape and duration, by way of leads 19 and 20, to a plasma source in cartridge 15; typically the current and voltage are approximately a few hundred kiloamperes and a few tens of kilovolts, respectively.

In response to the electric energy supplied to cartridge 15 by power supply 17, the cartridge supplies a high temperature, high pressure plasma jet to the rear of projectile 16 which is loaded in breech 14 of barrel bore 13. The plasma jet is derived from a dielectric tube in cartridge 15. The tube contains an ionizable substance in spheres or thin elongated drinking strawlike tubes; the contents can be water or powder fillers containing polyethylene or combinations thereof. The tube has an interior wall that forms a capillary passage. When the pulse from source 17 is derived, a discharge voltage is applied between spaced electrodes at opposite ends of the tube so that an ionizable dielectric substance on the tube walls is ionized to form a plasma. The diameter of the tube interior across the passage is relatively short compared to the distance between the electrodes to form the capillary passage. The end of the capillary passage adjacent projectile 16 is flared to form a nozzle through which the jet is injected into barrel 13 at the rear of projectile 16. The jet expands and becomes cooler as it flows through the outwardly flared nozzle as it enters bore 13. The blocked end of the capillary tube passage closes the bore in breech 14 where cartridge 15 is located. The plasma in the capillary passage between the electrodes forms an electric discharge channel in which ohmic dissipation occurs to produce a high pressure. The high pressure in the capillary causes the plasma in the passage to flow longitudinally in the passage and through the open, nozzle end of the passage to accelerate projectile 16.

The energy of supply 17 necessary to form the plasma can be obtained from several different sources, such as an inductor, a capacitor bank, a homopolar generator, a magneto hydrodynamic power source driven by explosives, or a compulsator, i.e., rotating flux compressor. In any event, the current of supply 17 is shaped and has a duration to produce an approximately constant pressure in barrel bore 13, acting on the aft end of projectile 16, while the projectile is being accelerated through almost the entire bore length, i.e., from breech 14 to muzzle 10.

The electric energy from supply 17 heats the dielectric in the plasma source of cartridge 15 to a temperature in the range of 3,000° K. to 500,000° K.; this is to be contrasted with the temperatures of no greater than 3,000° Kelvin achieved with chemical explosives. Typical chemical explosives in cartridges contain nitrogen, oxygen, carbon and hydrogen. In contrast, the plasma source of cartridge 15 uses ions of carbon, hydrogen and electrons thereof.

Due to the combination of high temperatures and low atomic weight elements derived from the plasma, the pressure of the plasma generated in the cartridge of FIG. 1 contains a large fraction of the plasma energy, whereby the energy is very efficiently transferred to kinetic energy that is applied to projectile 16, either directly or through the intermediary of a contained fluid having low atomic weight constituents (e.g., hydrogen). As projectile 16 is accelerated through barrel 13, it is chased by the plasma or the plasma and the low atomic weight constituents of the fluid. The plasma or the plasma and the fluid constituents are able to keep up with the projectile being accelerated through bore 13 because the sound speed of the low atomic weight elements of the plasma and fluid is much higher than the speed of projectile 16. The energy supplied by the plasma typically exerts a pressure in the range of 100 bars to approximately a few hundred kilobars on projectile 16.

The plasma flows longitudinally in bore 13 without contacting the wall of barrel 12 because the plasma passes through a cooling fluid 102 (which may be liquid or gaseous) in rigid wall container 101 (FIG. 2) immediately downstream of the nozzle in the plasma source; projectile 16 rests against a wall of container 101 in a chamber for the liquid. The plasma drags fluid 102 from container 101; if the fluid is a liquid, the plasma vaporizes the liquid. Vapor thus derived from fluid 102 forms a boundary layer in bore 13 between the plasma jet and the wall of barrel 12 to prevent the very hot plasma from contacting and ablating the wall. The plasma flow in bore 13 is maintained longitudinal and the boundary layer is established by proper selection of the cross-sectional area of the nozzle, container 101, and bore 13. In particular, the exit cross-sectional area of the nozzle for the plasma jet is considerably smaller than that of container 101, which in turn has a cross-sectional area appreciably larger than that of bore 13. Typically, the exit cross-sectional area of the nozzle is at least one-third to one-fourth that of bore 13, and at least one-fifth to one-tenth that of container 101. Container 101 has sufficient length to enable the fluid in the container to exert a drag force on the plasma jet to create the boundary layer; typically the container 101 has a length of about three times the diameter of bore 13. The length of container 101 and, therefore, the distance that the jet travels thru the fluid in the container are also a function of the energy in the plasma jet.

The plasma jet establishes a pressure differential between opposite end faces of container 101, i.e.,between first and second faces against which the nozzle and projectile 16 respectively bear initially. The pressure differential along the length of container 101 provides a continuous flow of the cold fluid in the container into bore 13 so the boundary layer is continuously replenished while plasma is flowing out of the nozzle to enable the boundary layer to stay cold and protect the wall of barrel 12 from very high temperature plasma. The gas behind projectile 16 is at a relatively constant temperature, typically about 3000° K., from the time the projectile begins to move until it leaves barrel 12. The constant temperature of the gases in barrel 12 helps to maintain the pressure in bore 13 behind projectile 16 constant. Because electric pulses having a predetermined waveshape (described, infra) are used to generate the plasma jet, the pressure in bore 13 remains constant throughout the interval while projectile 16 is accelerated through barrel 12. Typically the plasma jet is generated for about one-half of the time while projectile 16 is moving through bore 13. The length of barrel 12 and the duration of pulses from supply 17 are such that the pressure behind projectile 16 when it passes through muzzle 10 is low enough to prevent the projectile from being kicked off the axis of bore 13 and yet provides proper sabot discard action. If the pressure is too high a side kick is likely, while too low a pressure causes improper sabot action.

Figure 2A:
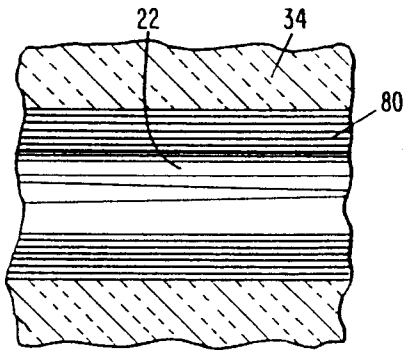
FIG. 2*a* is a partial view of a modified capillary passage structure in accordance with an alternate embodiment of the invention.
Figure 2:
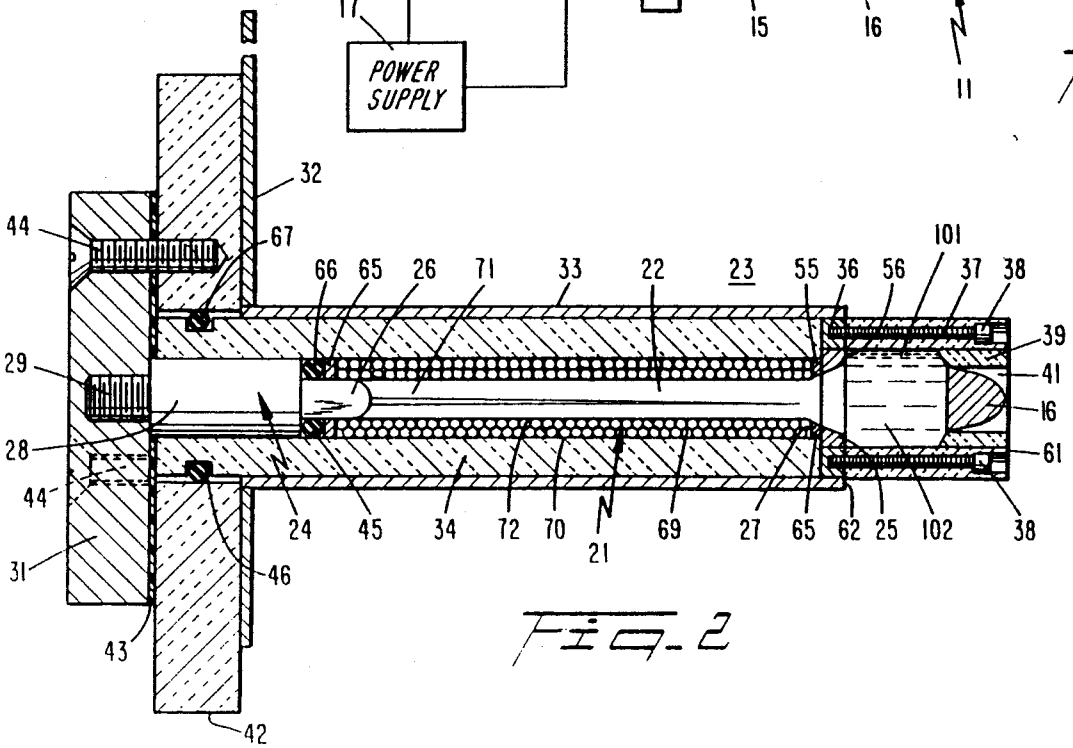
FIG. 2 is a cross-sectional view of a portion of the apparatus schematically illustrated in FIG. 1.

Reference is now made to FIG. 2 of the drawing wherein a cross-sectional view of cartridge 15 is illustrated as including dielectric tube 21 having an internal bore 22 that forms cylindrical capillary passage 22. Dielectric tube 21 is formed from a dielectric ionizable substance including at least one element that is ionized in response to a discharge voltage from power supply 17. In one embodiment, the ionizable substance fuel is formed as an ablatable filler contained in many small, individual spheres 69 packed between metal end faces 65, as well as between thin cylindrical rigid walls 70 and 72 of tube 21. Spheres 69 are formed of a dielectric ionizable compound and contain a solid dielectric ionizable powder or granular filler compound. The compound consists of low molecular weight elements, e.g., hydrogen and carbon, as formed, e.g., from polyethylene. Walls 70 and 72 are formed of an easily ruptured dielectric, e.g., a copolymer of vinyl chloride and vinyl acetate. The spheres 69 have a combined surface of 100 to 1000 times the surface area of wall 70. Typically the spheres 69 have an inertial mass density much greater, e.g., 100 times, that of the plasma. The geometry and materials in and of spheres 69 are such that the spheres increase the electric resistance of the plasma to match the impedance of a pulse forming network included in power supply 17, to ease the requirements of the power supply. The plasma quickly flows through the filler in the spheres and is cooled by them to help prevent ablation of the walls of bore 13 of barrel 12 by the plasma. Alternatively, a confined mass of the solid dielectric ionizable powder compound or a liquid such as water is located in a dielectric, ionizable plastic bag having an annular cross section and rigid walls that are the same as walls 70 and 72. In another embodiment, as illustrated in FIG. 2*a*, the solid or liquid filler is contained in many thin drinking straw-like, dielectric, ionizable plastic tubes 80, having longitudinal axes parallel to the common axis of bores 13 and 22. Different ones of containers 80 have different wall thicknesses to control the length of time from the breakdown between electrode assemblies 23 and 24 to ignition of the ablatable ionizable material in the containers. The material in the thin walled containers is ablated and ionized into a plasma prior to the material in the thick walled containers. Preferably, the thin walled containers are in proximity to electrode assembly 23 and barrel 12, and contain a liquid, while the thick walled containers are proximate breech 14 and electrode assembly 24. Thereby the plasma formed from the liquid in thin walled containers has a lower temperature than that of the thick walled containers. The lower temperature plasma from the liquid in the thin walled containers has a tendency to form a boundary layer on the wall of the barrel 12 to help cool the barrel when the higher temperature plasma from the solid ablatable grains in the thick wall containers flows through the barrel a few microseconds after the boundary layer has been formed. Control of the ignition time of the contents of the various containers 80 is also important to achieve shaped, time dependent pressure curves, as illustrated in FIG. 3.

The use of fillers or liquids inside elongated straw-like tubes 80, having a length to diameter ratio of considerably more than 10:1, increases the resistance during the discharge between electrode assemblies 23 and 24 by a factor of about four compared to the resistance of empty tubes made of the ablatable material. Increasing the resistance between electrode assemblies 23 and 24 during the discharge is important for three main factors, namely: (1) lower current for needed power, (2) shorter capillary and (3) cooler plasma jet. The importance of each of these factors relates to the size and weight of system components. Lower currents reduce ohmic losses in power supply 17 which reduces overall device weight. The shorter capillary reduces the length and width dimensions of the plasma cartridge 15. Reduction in plasma jet temperature aids the cooling in a mixing chamber where fluid container 101 and projectile 16 are initially located.

The voltage from supply 17 is supplied across electrode assemblies 23 and 24 having carbon segments 25 and 26 at the open and closed ends of passage 22, respectively. Segment 26 is formed as a generally cylindrical stub having an outer edge that engages the interior wall of tube 21 and extends longitudinally into passage 22. Electrode segment 25 is formed as a carbon ring that abuts against planar end 55 of end plate 65 for tube 21, to assist in holding the tube in situ. Ring 25 includes a central cylindrical aperture that is tapered outwardly to assist in forming the nozzle for the plasma jet. Ring 25 is also dimensioned and positioned so that face 56 thereof abuts against the portion of the planar rear face of cylindrical water container 101 farthest from the axis of tube 21. Projectile 16 abuts against the front face of container 101. Container 101 and projectile 16 are thereby maintained by ring 25 and collar 37 in situ in cartridge 15, at breech end 14 of barrel bore 13.

Tube 21 is flared at end 27 to match the flare of ring 25 so the tube and ring 25 form the nozzle for the plasma jet formed in capillary passage 22. The plasma jet flowing through the outwardly flared nozzle is ultimately injected against the back face of projectile 16 and into barrel bore 13; the jet expands and is cooled as it enters the barrel bore because it flows through flared nozzle end 27. However, the jet flow is basically longitudinal in bore 13 by designing the area of ring 25 that abuts against container 101 to have an area that is about one-third to one-fourth that of the cross-section of bore 13 and about one-fifth to one-tenth that of the cross-section of container 101. The length of container 101 in the axial direction of bore 13 is about three times the diameter of the bore.

Electrode 24, at the closed end of passage 22, includes a cylindrical metal segment 28 from which stub segment 26 extends. Cylindrical segment 28 is coaxial with stub segment 26, and has a longitudinal axis coincident with the longitudinal axis of tube 21 and a radius equal to the radius of wall 70. Cylindrical segment 28 includes a threaded portion 29 which extends axially in the direction opposite from that of stub segment 26. Segment 29 is threaded into a threaded bore on metal plate 31; plate 31 has a circular cross section with a radius considerably greater than the common radii of wall 70 and cylindrical segment 28. Thus, electrode 24 is formed of stub segment 26, cylindrical segment 28 and metal plate 31 which block passage 22 at the end of dielectric tube 21 proximate breech 14 and remote from the region where projectile 16 enters barrel bore 13. Lead 20 is connected to plate 31 by a suitable connector which can fit about the circular periphery and exposed face of plate 31, to provide a low impedance path between power supply 17 and electrode 24.

A low impedance connection from lead 19 to carbon ring 25 of electrode assembly 23 is established by metal plate 32 that extends radially of cartridge 15 and the axis of tube 21. Metal plate 32 abuts against and is fixedly connected to the periphery of copper sleeve 33 at the end of the sleeve remote from collar 37. Sleeve 33 is concentric with tube 21 and the elements of electrode 24. Sleeve 33 is electrically insulated from tube 21 by dielectric tube 34 that is coaxial with tube 21 and extends between plate 31 and carbon ring 25.

The exterior wall 70 of tube 21 and the cylindrical wall of electrode segment 28 abut against the interior wall of tube 34, which assists in holding tube 21 and electrode assembly 24 in situ. The exterior wall of tube 34 abuts against the interior wall of sleeve 33; the exterior wall of sleeve 33 abuts against the wall of the bore in breech 14 when cartridge 15 is inserted into the breech. This construction enables sleeve 33 and tube 34 to withstand the very high pressure which is generated in bore 22 when the dielectric of tube 21 is ionized in response to the application of a voltage pulse from power supply 17.

To conduct current flowing in plate 32 and sleeve 33 to carbon ring 25, copper ring 36 is positioned and held in place between the inner diameter of sleeve 33 and the outer diameter of ring 25, so ring 36 abuts against the face of tube 34 that is aligned with planar end wall 65 of tube 21. Ring 36 is held in situ by cylindrical dielectric collar 37 having longitudinally extending threaded bores into which screws 38 are threaded. Collar 37 is integrally formed with dielectric sleeve 39, having an interior bore 41 that is aligned with bores 22 and 13; bore 41 has the same diameter as bore 13 of gun barrel 12. The diameter of bore 41 and the diameter of flared nozzle 27 where it intersects face 56 are approximately the same.

Carbon ring 25, however, has a radius less than that of the chamber filled by container 101, so that the carbon ring provides a seat for one face of rigid cylindrical container 101 that contains projectile propelling fluid 102, having low atomic weight constituents and the proper geometry for the boundary layer. Typical of the fluids 102 are water, propane [$CH_2(CH_3)_2$], $CH_4$, high pressure hydrogen gas ($H_2$), liquid hydrogen, lithium hydride (LiH), pentane ($C_5H_{12}$), methanol ($CH_3OH$), a boron hydride (e.g., $B_2H_6$) and chemical mixtures which are in separate containers that are primed by the jet to react and produce high pressure fluids (e.g., $4H_2O+3Fe \rightarrow Fe_3O_4+4H_2$), as well as metal hydrides (e.g., of N or Fe). The gases produced by the fluid 102 in container 101 have a relatively high pressure of about two to four thousand atmospheres to assist in providing the boundary layer between the plasma jet in bore 13 and the wall of barrel 12.

Projectile 16 bears against the face of container 101 closest to bore 13. Thereby container 101 is positioned at the open end of the capillary passage formed by passage 22 and projectile 16 is immediately downstream of the container to be responsive to high pressure low atomic weight gases of the plasma and contained fluid 102 in container 101. Container 101 has a diameter appreciably greater than that of the exit flared end 27 of passage 22 and of bore 13 so that the cylindrical surface of the container bears against and extends along the majority of the cylindrical inner wall of collar 37 so that a large quantity of contained fluid 102 is provided. The forward end of container 101 is tapered toward barrel 12 to facilitate the flow of fluid 102 against the back end of projectile 16.

When cartridge 15 is loaded into breech 14 of gun 11, the periphery of collar 37 engages the interior cylindrical wall of the breech bore 13. The exterior co-planar faces of collar 37 and tube 39, along edge 61, engage forward wall 63 of breech 14. Forward edge 62 of sleeve 33 engages corresponding face 64 in breech block 14.

To electrically insulate plates 31 and 32 from each other and provide sufficient strength for cartridge 15 to withstand the high pressures generated in passage 22, plates 31 and 32 are spaced from each other by dielectric face plate 42, formed of a material able to withstand high pressure shocks, such as polyethylene. Metal plate 32 is bonded to the face of plate 42 facing bore 13. Plate 31 and polyethylene film 43 are fixedly mounted on the other face of plate 42 by screws 44 which extend through threaded bores in plates 31 and 42.

Dielectric O-rings 45 and 46 assist in holding the entire assembly in place. O-ring 45 has inner and outer diameters approximately equal to the outer diameter of stub cylinder 26 and the diameter of the inner wall of tube 34, respectively. O-ring 45 fits between end plate 65 of tube 21 remote from barrel 12 and shoulder 66 on cylindrical segment 28 and bears against the inner diameter of sleeve 34. O-ring 46 fits in peripheral, circular groove 67 about the periphery of tube 34, and has an outer portion that bears against the inner circumference of annular plate 42. O-rings 46 and 45 also aid in preventing electrical breakdown since they stop gas or plasma from blowing past electrode 24 and around tube 34, to prevent an electrical short-circuit from electrode 24 to plate 32 or sleeve 33.

To initiate the discharge under the initial atmospheric conditions which exist in cartridge 15 and gun 11, electrode 24 includes an elongated rod 71 preferably made of carbon, or a metal wire, made, e.g., of aluminum; rod 71 extends longitudinally from the tip of stub cylinder 26 along the axis or inner wall of passage 22 into proximity with ring 25. In response to sufficient voltage being fed by supply 17 to cartridge 15, current flows between rod 71 and ring 25 via a discharge space between the rod and ring. The rod is consumed by the current but the discharge between ring 25 and cylinder 26 continues. Other types of atmospheric discharge initiators can be used; for example, a thin carbon coating can line passage 22. Alternatively, for multiple shot cartridges wherein spheres 69 are replaced by a solid dielectric or the spheres are in containers, only one of which is spent with each shot, a reusable spark plug type structure is located between ring 25 and stub cylinder 26. The spark plug type structure is supplied with a very high voltage breakdown pulse immediately before the pulse from supply 17 is generated. The breakdown caused by the spark plug type structure occurs between ring 25 and cylinder 26 at the time when energy from supply 17 is initially applied between ring 25 and cylinder 26.

While the discharge between electrodes 24 and 25 is occurring the energy from supply 17 is applied between electrodes 24 and 25. The energy from supply 17 maintains the discharge between electrodes 24 and 25 to cause plasma to flow longitudinally in passage 22 to form an electric discharge channel between stub cylinder 26 and carbon ring 25. The resistance of the electric discharge channel is on the order of one-tenth of an ohm, which is considerably higher than the sum of all other resistances in the circuit between the terminals of power supply 17. Thereby, virtually all of the energy from power supply 17 is dissipated in the discharge channel formed in passage 22. The plasma formed in passage 22 is highly ionized and very hot, with temperatures ranging from 3,000° Kelvin to as high as 500,000° Kelvin. Because of the capillary nature of passage 22, i.e., the fact that the length to diameter ratio of the passage is at least ten to one, a high pressure is produced in the passage to cause the plasma in the capillary to flow longitudinally into nozzle 27.

The breakdown between stub cylinder segment 26 and carbon ring 25 is initiated along inner dielectric wall 70 of dielectric tube 21 and spreads to dielectric spheres 69 in sleeve 21. Once breakdown along inner wall 70 and of spheres 69 occurs, plasma from the inner wall and spheres rapidly expands radially into passage 22 to fill the capillary passage defined by the passage. In response to the plasma filling passage 22, there is formed an electric discharge channel which is effectively a resistor between electrodes 24 and 25. The resistance of the discharge channel can be expressed as:

$$R = \frac{l}{\pi a^2 \sigma},$$

where R = the resistance between electrodes 24 and 25, l = the length of sleeve 21 between electrodes 24 and 25, $a$ = interior radius of sleeve 21, and $\sigma$ = the conductivity of the plasma in the thus formed duct.

In response to current flowing through the plasma between electrodes 24 and 25 ohmic dissipation in the plasma transfers energy efficiently from high voltage supply 17 into the plasma. Simultaneously, radiation emission and thermal conduction transport energy from the plasma in passage 22 to spheres 69, to ablate additional plasma from the spheres and replace plasma ejected through nozzle 27. During the period while the plasma flows through passage 22, spheres 69 remain approximately in situ even though they are not physically confined because the plasma sweeps through the passage at very high speed and with a very high pressure. Thereby, material in tube 21 is consumed as fuel and ejected as plasma in response to the electric energy provided by high voltage supply 17.

The resulting high plasma pressure in passage 22 causes the plasma in the passage to flow longitudinally along the passage and rapidly out of nozzle 27. Because the other end of passage 22 is blocked by electrode 24, plasma can blow only out of nozzle 27.

The length, l , radius, $a$, and atomic species, typically hydrogen and carbon, in the plasma on the interior diameter of tube 21 are chosen such that the discharge resistance R is relatively large, such as 0.10 ohm, so that it considerably exceeds the sum of the resistance of power supply 17, leads 19 and 20, and electrodes 24 and 25.

When power supply 17 initially supplies current to leads 19 and 20 a relatively small amount of plasma is supplied through nozzle 27 to mix with fluid 102 in container 101. The quantity of plasma is sufficient to rupture the end of container 101 abutting against nozzle 27 so that the plasma jet flowing thru the nozzle is cooled by the much lower temperature of fluid 102. The plasma drags fluid 102 from container 101 to cause vapor from the fluid to surround the plasma jet and form the boundary layer between the jet and wall of barrel 12 as the jet travels down bore 13. During this initial heat exchange between the plasma initially flowing through nozzle 27 and the fluid 102, the plasma temperature is reduced to assist in preventing damage to the walls of barrel bore 13 by the plasma. During the initial heat exchange phase, rapid turbulent mixing occurs between the plasma and fluid 102, to cool the plasma and heat the fluid to temperatures of a few thousand degrees Kelvin, i.e., to a temperature between a chemical hot shot, typically 2,000° Kelvin, and the temperature obtained from light gas guns, typically 6,000° Kelvin. The differential pressure established by the jet across the end walls of container 101 and in the axial direction of fluid 102 in the container causes the fluid to continuously be dragged into bore 13 while the jet is flowing through the nozzle to provide the boundary layer. Capillary passage 22 functions as a high impedance coupling device that efficiently transfers energy from supply 17 into fluid 102, which initially has a density of a typical liquid.

After the initial heat exchange resulting from mixing, the power supplied by source 17 to the dielectric of cartridge 15 is increased, with a consequent increase in the quantity and pressure of plasma ejected through nozzle 27. This initiates movement of projectile 16 from breech 14 into bore 13 toward muzzle 10. The plasma heats fluid 102 to cause partial dissociation of the materials in the liquid into the low atomic weight constituents thereof, i.e., the hydrogen of the previously mentioned compositions is dissociated from the remaining elements. The hydrogen constituents increase the sound speed of the propelling gas acting against projectile 16. The gas sound speed continues to increase as projectile 16 is accelerated through the length of bore 13, from the proximity of the breech end 14 to the muzzle end 10. The type of fluid in container 101 affects the peak temperatures of the gases in barrel 13 acting against projectile 16. By reducing the peak temperature due to the mixing action between the plasma and fluid 102 during the initial phase, there is a substantial reduction of barrel ablation.

Figure 3A:
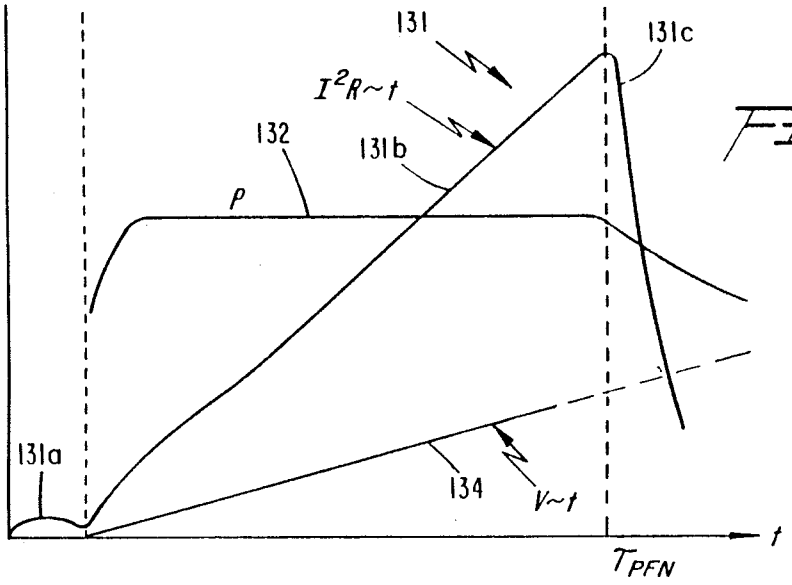
FIGS. 3*a* and 3*b* are waveforms helpful in describing the operation of two embodiments of the apparatus illustrated in FIGS. 1 and 2.

In FIG. 3*a* are illustrated one embodiment of exemplary waveforms 131, 132 and 134 respectively indicative of: (a) the power supplied by supply 17 to the dielectric of cartridge 15, (b) the pressure in bore 13 acting on projectile 16, and (c) the velocity of the projectile; each of these variables is illustrated as a function of time.

Power curve 131 is obtained by properly shaping the pulse supplied by power supply 17 to cartridge 15. The impedance across power supply 17 is predominantly resistive, comprising primarily the resistance of the capillary passage between electrodes 23 and 25. The power coupled by supply 17 to cartridge 15 is the current (I) of the power supply squared times the resistance of the capillary, i.e., $I^2R$; the capillary resistance is indicated supra, as $l/\pi\alpha^2\sigma$.

Initially, to attain the cooling of the plasma by fluid 102 and heating of the fluid by the plasma without movement of projectile 16, the output power of supply 17 rises from an initial value, goes through a relatively small amplitude peak and then decreases toward zero, as indicated by portion 131*a* of power waveform 131. Thereafter, the power coupled by supply 17 to cartridge 15 increases approximately linearly, as indicated by the approximately linear variation 131*b* of curve 131. Because of the fixed volume between electrodes 23 and 25 the increasing current and power applied to the electrodes results in increased current and power in transverse cross sections between the electrodes, whereby the current and power densities between two fixed points in the capillary passage increase. The linear increase 131*b* in the output power of supply 17 continues for virtually the entire time while projectile 16 is being accelerated through bore 13. When projectile 16 has travelled through about one-half of bore 13, there is a sharp and sudden decrease of the power output of supply 17 to a zero value, as indicated by waveform portion 131*c*.

In response to the relatively low amplitude initial power portion 131*a* of curve 131, there is heating of confined fluid 102 and cooling of the plasma jet. During waveform portion 131*b*, while the power of supply 17 increases linearly, substantially constant pressure is developed in bore 13 behind projectile 16. The constant pressure acts on the rear of projectile 16, i.e., the portion of the projectile facing the breech end of barrel 12. The constant pressure has a value sufficient to accelerate projectile 16 along the length of bore 13. The pressure acting on the aft end of projectile 16 remains constant even though the volume in bore 13 is constantly increasing as the projectile is being translated through the bore. This is possible because a shaped constantly increasing power pulse having a waveform indicated by portion 131*b* is coupled from supply 17 to cartridge 15. The constant pressure is maintained because the quantity of plasma supplied by cartridge 15 to bore 13 increases in response to the increased output power of supply 17.

Simultaneously, the plasma mixes with the low atomic weight constituents in fluid 102 so that the total quantity of low atomic weight, high sound speed molecules acting in bore 13 against the aft end of projectile 16 increases. These low atomic weight, high sound speed molecules resulting from the plasma mixing with the fluid 102 and acting against the rear of projectile 16 have quite a high relatively constant temperature. The combined effects of the increased number of low atomic weight molecules and the high constant temperature at the rear of projectile 16 enable the pressure in bore 13 behind projectile 16 to remain substantially constant, per wave segment 132, as the projectile is accelerated through the bore, from in proximity to the breech end thereof to about half way to the muzzle end. The constant pressure acting against the aft end of projectile 16 while the power increases during wave segment 131*b* causes the projectile to be constantly accelerated whereby the speed of the projectile increases approximately linearly, as indicated by waveform 134, as the projectile traverses bore 13, between the breech and muzzle ends thereof. Waveform segment, 131*b* continues until projectile 16 has travelled through about one-half of the length of bore 13. Then the power drops sharply, as indicated by waveform segment 131*c*. However, the pressure in bore 13 acting on projectile 16 drops only moderately, as indicated by waveform segment 132*b*. The projectile velocity continues to increase, despite the pressure drop, but at a slightly decreased rate so that the projectile path upon leaving muzzle 10 is in line with the axis of bore 13.

Figure 3B:
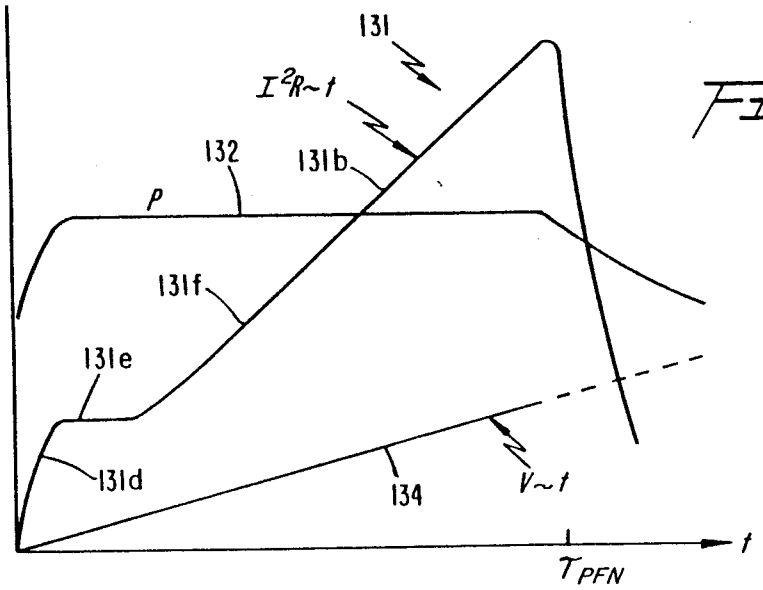

In accordance with a further embodiment illustrated in FIG. 3*b*, the pre-heating and cooling effects provided by waveform segment 131*a* are attained at the beginning of motion of projectile 16, instead of while the projectile is at rest. To this end, the power (square of the current) fed to supply 17 between electrode assemblies 23 and 24 initially increases in almost a step manner, as indicated by waveform segment 131*d*, then has a relatively constant value, as indicated by waveform segment 131*e*. Segment 131*e* continues until it intercepts straight line variation 131*f* of power curve 131 that has approximately line variation 131*f* of power curve 131 that has approximately the same slope as segment 131*b*;

typically segment 131*e* intercepts segment 131*f* after projectile 16 has travelled about one-tenth of the way down barrel 12. The power between wave segments 131*d*, 131*e* and 131*f* causes sufficient energy to be imparted by supply 17 to the plasma to cool the plasma by fluid 102 and mix the plasma and fluid to attain the same results as provided by waveform segment 131*a*. Thereafter, the power applied between assemblies 23 and 24 has the same characteristics as the remainder of waveform segment 131*b* and of segment 131*c*. The power waveform illustrated in FIG. 3*b* causes pressure and velocity waves 132 and 134 in the embodiments of FIGS. 3*a* and 3*b* to have the same shapes.

Figure 4:
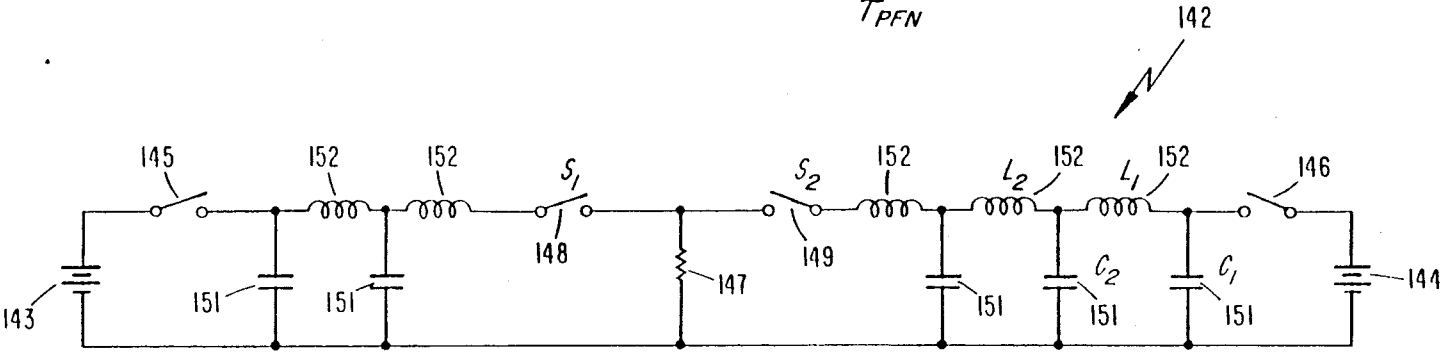
FIG. 4 is a circuit diagram of a power supply for supplying a pulse having a predetermined waveshape to achieve the waveforms of FIG. 3.

Reference is now made to FIG. 4 of the drawing, a circuit diagram of one embodiment of power supply 17 which enables the stated shaped current and power variations to be achieved. Basically, power supply 17 includes pulse forming networks 141 and 142, respectively connected to DC power supplies 143 and 144 by switches 145 and 146. Pulse forming networks 141 and 142 supply current to load resistor 147 by switches 148 and 149, respectively. Switches 148 and 149 are preferably triggered into a conducting condition and are cut off by a control source or in response to the current flowing through them dropping below a predetermined value; e.g., switches 148 and 149 are ignitrons or solid state equivalents thereof, such as triacs, or banks of power transistors. Resistor 147 is, in actuality, the relatively constant capillary resistance of cartridge 15 between electrodes 24 and 25. As discussed supra, the 0.10 ohm resistance between electrodes 24 and 25 is typically the largest resistance between the output terminals of power supply 17. Switches 148 and 149 are opened and closed in a timed relationship by an external trigger source or by self-opening action in response to the current in them dropping below a predetermined level to supply current waveforms of pulse forming networks 141 and 142 to load 147. Pulse forming networks 141 and 142 are conventional devices, including shunt capacitors 151 and series inductors 152. The number of shunt capacitors - series inductance stages in each of pulse forming networks 141 and 142, and the values of the shunt capacitors and series inductors, is determined by the amplitude and slope of wave portion 131 necessary to achieve the desired velocity for projectile 16 as it leaves muzzle 10, as well as the ability of gun 11 to withstand the pressures and shocks associated with accelerating projectile 16 from breech 14 to muzzle 10. In addition, the parameters of pulse forming network 141 are selected to achieve the desired shape and duration for waveform segment 131*a* or segments 131*d* and 131*e* which provide initial heating of fluid 102 and initial cooling of plasma injected into the fluid as well as the initial mixing of the fluid and plasma.

Initially, switches 145 and 146, which respectively connect DC power supplies 143 and 144 to networks 141 and 142, are closed for a sufficient period of time to charge each of shunt capacitors 151 of pulse forming networks 141 and 142 to the voltages of supplies 143 and 144. With capacitors 151 fully charged, the waveform of FIG. 3*a* is synthesized by closing switch 148 to couple power from network 141 to load 147, while switch 149 remains open. While switch 148 is closed, a resonant circuit is provided by capacitors 151 and inductors 152 through switch 148 to load 147. Current flows for slightly less than one-half a cycle of the period of the resonant circuit of pulse forming network 141 through resistor 147, at which time switch 148 is open circuited because of the decreased current flow therein. During the time while switch 148 initially couples current from network 141 to load 147, slightly less than one positive going hump of a sinusoidal current wave is supplied by pulse forming network 141 to load 147. Thereby, just before switch 149 is connected to load 147, a positive current having an amplitude somewhat greater than zero, with a negative slope, is flowing through load 147. The power variation produced in load 147 during this interval is indicated by waveform segment 131*a*, FIG. 3. As indicated supra, the power during this initial slightly less than half cycle of current through pulse forming network 141 causes plasma to be initially injected into fluid 102, to develop sufficient pressure to cause mixing of the fluid and plasma.

Simultaneously with switch 148 being open circuited, switch 149 closes, causing current to flow from pulse forming network 142 into load 147. Pulse forming network 142 includes many more sections and has a much lower resonant frequency than that of pulse forming network 141. In addition to synthesizing the waveform 131 of FIG. 3*a*, the capacitors of network 142 are charged to a much higher voltage by source 144 than the capacitors of network 141 are charged by source 143. Thereby, positive current having a positive going slope and power waveform (as indicated by segment 131*b*) resembling a linear function is initially supplied by network 142 to load 147. When the slope of the current supplied by network 142 to load 147 begins to decrease appreciably switch 148 is again activated to couple current from network 141 to load 147. At this time capacitors 151 are again charged to the voltage of supply 143 because switch 145 is closed immediately after switch 148 is open, whereby positive current again flows from network 141 to load 147. Simultaneously, current is supplied by pulse forming network 142 through switch 149 to load 147. Thereby, load 147 is responsive to the combined output currents of pulse forming networks 141 and 142.

The current from network 141 augments that from network 142 to maintain a linear relation for the squared current waveform and hence for the power waveform supplied by source 17 to cartridge 15. To this end the currents from networks 141 and 142 are decoupled from load 147 when the positive current of network 141 begins to decrease and the relative resonant frequencies of networks 141 and 142 are properly selected. In addition, pulse forming network 141 has a characteristic impedance which provides a three to one mismatch between source 143 and load 147 when network 141 is solely connected to load 147. When only network 142 is connected to load 147, the characteristic impedance of pulse forming network 142 provides a two to one mismatch between source 143 and the impedance of load 147, so that there is greater current flow to the load while switch 149 is closed and while switch 148 is closed to load 147. The resonant frequencies of pulse forming networks 141 and 142 and the activation times of switches 148 and 149 are such that the squared current flow through load 147 is constantly increasing, as indicated by waveform portion 131*b*. The resonant frequencies of pulse forming networks 141 and 142, the travel time of projectile 16 and the length of barrel 12 are such that projectile 16 is about half way between the breech and muzzle of barrel 12 when switches 148 and 149 open.

The waveform of FIG. 3*b* can be synthesized by the pulse forming network of FIG. 4, by appropriately adjusting the resonant frequencies of networks 141 and 142 and changing the activation times of switches 148 and 149, and by adjusting the voltages of the sources 143 and 144 so that they are equal. In particular, the resonant frequency of network 141 is selected to be one-third that of network 142. Switches 148 and 149 are activated so that network 141 supplies three half cycle current pulses to load 147, while network 142 is activated to supply current pulses having a duration of one-half cycle to load 147. After capacitors 151 of networks 141 and 142 have been fully charged by DC power supplies 143 and 144, switches 148 and 149 are simultaneously closed, causing the square of the current supplied to load 147 to have the wave shape indicated by wave segments 131*d* and 131*e*, FIG. 3*b*. Wave segment 131*d* is derived during the first one-half cycle of current flow from network 141 to load 147. During this interval, network 142 is supplying a relatively linear current to load 147. The square of some of the current supplied to load 147 by networks 141 and 142 increases in a substantially linear manner during the first positive half cycle of the current supplied by network 141 to load 147, as indicated by waveform segment 141*d*.

During the second half cycle of current flow from network 141 to load 147, the negative current supplied by network 141 to load 147 is combined with the positive current supplied to the load by network 142, to maintain the square of the sum of the current supplied by both networks to the load substantially constant, as indicated by waveform segment 131*e*. During the third half cycle of current flow in network 141, a positive current is again supplied by network 141 to load 147. Simultaneously, positive current is being supplied by network 142 to load 147. The sum of the currents supplied by networks 141 and 142 to load 147 during the third half cycle of current flow in network 141 causes a linear upward ramping of the square of the sum of the currents in load 147, as indicated by the initial portion of wave segment 131*f*. The square of the sum of the currents supplied to load 147 during the initial portion of wave segment 131*f* has a slope that is considerably less than that of the current supplied to the load during wave segment 131*d* because the slope of the sinusoidal contribution from network 142 is less during this interval than during the interval while wave segment 131*d* was being derived.

It is also possible to consider the operation of the device during the interval while wave segment 131*e* is being derived such that the current from network 142 flows into load 147 and into network 141, to reduce the load current, while charging capacitors 151 of network 141 to the same voltage that subsisted across these capacitors at the time switch 148 was originally closed. Thereby, capacitors 151 are capable of supplying increased current to load 147 during the next half cycle of the oscillating frequency of network 141, to achieve the initial segment of the linear ramp waveform segment 131*f*. The remaining linear portion of waveform segment 131*f* is achieved by proper selection of the values of capacitors 151 and inductors 152 in network 142. In particular, the sections of network 142 connected close to load 147 have a high internal impedance and short time constant relative to the low impedance and long time constant of the sections connected close to source 144. Such a result is attained by providing the correct number of sections and the correct values for the inductors and capacitors thereof, in a manner well known to those of ordinary skill in the art.

By arranging the impedances and time constants of the various sections of network 142 in the stated manner, the straight line variations of the square of the current supplied by networks 141 and 142 to load 147 are maintained relatively constant, as indicated by waveform segment 131*f*. The straight line variation of the square of the current in load 147 is maintained despite the tendency for network 141 to cause less current to flow through the load during even half cycles of the current waveforms coupled by network 141 to the load. As wave segment 131*f* progresses, the amplitude of the current from network 141 decreases due to the natural damping effect provided by the resistive components in the inductors of the network, whereby at the time that the linear portion of wave segment 131*b* is completed, the current flowing to load 147 from network 141 is substantially zero, for a prolonged time interval, causing switch 148 to open. Simultaneously, the current supplied by network 142 to load 147 begins to decrease.

The characteristic impedance of network 142 is such that there is a reflected wave from capacitor 151 connected closest to switch 146, so that the current supplied by network 142 to load 147 decreases at a very fast rate, as indicated by waveform segment 131*c*. The decreased current supplied by network 142 to load 147 causes switch 149 to open, whereby load 147 is decoupled from pulse forming networks 141 and 142 and energy is no longer supplied to the load, whereby the plasma derived from source 21 is extinguished.

While there have been described and illustrated several specific embodiments of the invention, it will be clear that variations in the details of the embodiment specifically illustrated and described may be made without departing from the true spirit and scope of the invention as defined in the appended claims. For example, the shaped current pulse can be utilized exclusively without the intermediary of fluid 102, to provide a plasma drive for projectile 16, if barrel 12 is able to directly withstand the high temperatures associated with the plasma output of cartridge 16.

What is claimed is:

1. Apparatus for accelerating a projectile in a passage adapted to receive the projectile by applying a high pressure gas to the rear of the projectile while the projectile is in the passage, the gas having sufficient pressure to accelerate the projectile along the passage longitudinal axis toward an open end of the passage, the apparatus comprising a plasma source for generating a plasma having a flow path toward the rear of the projectile, and means for applying increasing power to the plasma throughout a region between a pair of fixed points longitudinally spaced from each other along the plasma flow path in transverse cross-sections of the plasma flow path, the power increase occurring for at least half the time while the plasma is between the points to energize the plasma so that pressure acting on the rear of the projectile resulting from the increasing power applied between the points to the plasma does not decrease substantially while the projectile is being accelerated by the gas in the passage, the means for increasing including means for increasing the power applied to the plasma between said fixed points in an approximately linear manner with time as the projectile is accelerated by the gas in the passage, the means for increasing further including pulse forming means responsive to a DC source, the pulse forming means including series inductors and shunt capacitors, switch means for connecting the pulse forming means to the DC source for charging the shunt capacitors prior to the projectile being accelerated by the plasma and for connecting the pulse forming means between the fixed points to supply increasing current to the fixed points and the plasma between them.

2. A method of accelerating a projectile in a barrel bore comprising the steps of:

(a) generating a pulsed plasma by applying an electric pulse to a pair of electrodes spaced longitudinally from each other along the length of a passage having a dielectric wall with an ionizable substance, the electric pulse having a predetermined wave shape and duration for applying a discharge voltage to the electrodes to establish a discharge in the passage, (b) applying the pulsed plasma to a projectile propelling mass located downstream from an outlet of a source of the plasma, the plasma and mass interacting so the mass is heated by the plasma and the plasma is cooled by the mass, constituents of the mass being sufficiently heated by the jet to become mixed with the plasma to form a high pressure mixture, (c) injecting the high pressure mixture into the bore against the rear of the projectile so the plasma is cooled sufficiently by the mass that the mixture does not cause substantially damage to walls of the bore, and (d) applying current that increases as a function of time to the plasma via the electrodes to control the plasma applied to the mass to cause additional propelling gas to be applied to the rear of the projectile while the projectile is being accelerated through the bore.

3. A method of accelerating a projectile in a barrel bore comprising the steps of:

(a) applying a plasma jet to a projectile propelling fluid located downstream from an outlet of a source of the jet, the fluid and jet interacting so the fluid is heated by the jet, constituents of the fluid being sufficiently heated by the jet to become mixed with the plasma to form a high pressure mixture, (b) injecting the high pressure mixture into the bore against the rear of the projectile so that the plasma flows longitudinally along the bore axis to accelerate the projectile along the bore axis, the fluid being dragged into the plasma so that the mixture does not cause substantial damage to walls of the bore, and (c) controlling the plasma jet applied to the fluid so there is no substantial decrease in the pressure of the plasma acting on the rear of the projectile while the projectile is being accelerated by the plasma in the bore, to increase the speed of the projectile as time progresses and the projectile is being accelerated by the plasma in the bore, the pressure being maintained substantially constant by increasing the power applied to the plasma approximately linearly with time as the projectile is accelerated by the plasma in the bore.

4. A method of claim 3 wherein the plasma is injected into the bore by a capillary tube having a dielectric that is heated to form the plasma by energy from a variable current supply and increasing the square of the current fed by the supply to the plasma in an approximately linear manner as a function of time while the projectile is accelerated in the bore by the plasma.

5. A method of claim 4 wherein the current increases for about one-half of the time while the projectile is travelling in the bore.

6. A method of accelerating a projectile in a barrel bore comprising the steps of:

(a) generating a pulsed plasma by applying an electric pulse to a pair of electrodes spaced longitudinally from each other along the length of a passage having a dielectric wall with an ionizable substance, the electric pulse having a predetermined wave shape and duration for applying a discharge voltage to the electrodes to establish a discharge in the passage, (b) applying the pulsed plasma to a projectile propelling mass located downstream from an outlet of a source of the plasma, the mass and jet interacting so the mass is heated by the plasma, constituents of the mass being sufficiently heated by the plasma to become mixed with the plasma to form a high pressure mixture, (c) injecting the high pressure mixture into the bore against the rear of the projectile so that the mixture flows longitudinally along the bore axis to accelerate the projectile along the bore axis, the mass being dragged into the plasma so that the mixture does not cause substantial damage to walls of the bore, and (d) applying current that increases as a function of time to the plasma via the electrodes to control the plasma applied to the mass to mix with a heated constituent of the mass to cause additional propelling gas to be applied to the rear of the projectile while the projectile is being accelerated through the bore.

7. Apparatus for accelerating a projectile in a passage adapted to receive the projectile comprising a plasma source for supplying a high pressure plasma to the bore behind the projectile so that the propelling plasma has an axial component, the plasma having sufficient pressure to accelerate the projectile in the passage, an electric pulse source, means for connecting the electric pulse source to the plasma source to energize the plasma, the plasma source including an elongated capillary plasma discharge passage having a longitudinal axis surrounded by a wall with many dielectric containers together having a large surface area relative to that of the wall and containing a dielectric ionizable substance from which the plasma is derived, a pair of electrodes spaced from each other at spaced points along the longitudinal axis, said electrodes being connected to said source and positioned relative to said containers to instigate a discharge in the substance of the containers to cause the plasma to propagate along the capillary passage toward the projectile while the projectile is in the passage adapted to receive it, different ones of said containers having different wall characteristics to control the relative ignition times of the substances therein, the pressure being maintained substantially constant by increasing the power applied to the plasma approximately linearly with time as the projectile is accelerated by the plasma in the bore.

8. A method of claim 7 wherein the plasma is injected into the bore by a capillary tube having a dielectric that is heated to form the plasma by energy from a variable current supply and increasing the square of the current fed by the supply to the plasma in an approximately linear manner as a function of time while the projectile is accelerated in the bore by the plasma.

9. A method of claim 8 wherein the current increases for about one-half of the time while the projectile is travelling in the bore.

10. The apparatus of claim 7 wherein the substance is water.

11. The apparatus of claim 7 wherein the substance is an ablatable powder-like filler.

12. The apparatus of claim 7 wherein the substance in certain of said containers is a liquid and in others of said containers is an ablatable powder-like material.

13. A method of accelerating a projectile along a longitudinal axis of a passage comprising the steps of generating a plasma by applying an electric pulse to a pair of electrodes spaced longitudinally from each other along the length of a passage having a dielectric wall with an ionizable substance, the electric pulse having a predetermined wave shape and duration for applying a discharge voltage to the electrodes to establish a discharge in the passage, the generated plasma forming a high pressure gas acting on the rear of the projectile while the projectile is in the passage, the gas formed by the plasma having sufficient pressure against the rear of the projectile to accelerate the projectile along the passage longitudinal axis, increasing the power applied to the plasma as a function of time so that the power applied to the plasma after initial projectile acceleration has progressively larger values as time progresses by thereafter applying to the plasma current that increases as a function of time to cause additional propelling gas to be applied to the rear of the projectile while the projectile is being accelerated through the projectile receiving passage, the power increase of the plasma occurring for more than half of the time while the plasma is being generated.

14. The method of claim 13 wherein the power applied to the plasma between the points and in the transverse cross-sections is increased so pressure applied to the projectile by the gas formed by the plasma is maintained approximately constant while the projectile is being accelerated by the gas.

15. The method of claim 13 wherein the high pressure gas is formed by an interaction between the plasma and a fluid containing a substantial quantity of hydrogen.

16. The method of claim 13 wherein the high pressure gas is formed by an interaction between the plasma and a confined fluid located between an outlet for a source of the plasma and the projectile.

17. A method of accelerating a projectile along a longitudinal axis of a passage comprising the steps of generating a plasma to form a high pressure gas acting on the rear of the projectile while the projectile is in the passage, the gas formed by the plasma having sufficient pressure against the rear of the projectile to accelerate the projectile along the passage longitudinal axis, increasing the speed of the projectile as time progresses and the projectile is being accelerated by the plasma in the passage by increasing the power applied to the plasma, the power increase occurring throughout the length of a region between a pair of fixed points in traverse cross-sections of a passage in which the plasma is derived, the power increase of the plasma between the points and in the transverse cross-sections occurring for approximately the entire time while the plasma is between the fixed points to control the plasma so there is no substantial decrease in the pressure of the gas acting on the rear of the projectile while the projectile is being accelerated by the gas in the passage, the plasma being derived by applying a discharge current between the fixed points in a capillary passage having a dielectric wall with a substance that is ionized by the discharge current, the power being increased by increasing the square of the current applied to the plasma between the fixed points in an approximately linear manner as a function of time while the projectile is accelerated by the gas.

18. A method of claim 17 wherein the current increases for about one-half of the time while the projectile is travelling in the passage.

19. Apparatus for accelerating a projectile in a passage adapted to receive the projectile comprising means for applying a high pressure gas to the rear of the projectile while the projectile is in the passage, the gas having sufficient pressure to accelerate the projectile along the passage longitudinal axis toward an open end of the passage, a plasma source for generating a plasma having a flow path into the means for applying the high pressure gas to the rear of the projectile, the plasma source including an electric pulse source connected to energize the plasma, the plasma source including a passage having a dielectric wall with an ionizable substance and a pair of electrodes spaced longitudinally from each other along the length of the passage, the electric source having a predetermined wave shaped and duration for applying a discharge voltage to the electrodes to establish a discharge in the passage and for thereafter applying to the plasma current that increases as a function of time to cause additional propelling gas to be applied to the rear of the projectile while the projectile is being accelerated through the projectile receiving passage, so increased power is applied to the plasma between the electrodes, the power increase being a function of time so that the power applied to the plasma after initial projectile acceleration has progressively larger values as time progresses and occurring for at least half of the time while the plasma is between the points.

20. The apparatus of claim 19 wherein the means for increasing includes means for increasing the power applied to the plasma between said fixed points and in said transverse cross-sections to maintain the pressure acting on the rear of the projectile substantially constant while the projectile is being accelerated by the gas in the passage.

21. The apparatus of claim 19 wherein the projectile receiving passage is downstream of the plasma source passage, the plasma source including means for injecting plasma from the plasma source passage into the projectile receiving passage, a confined mass of projectile propelling fluid positioned between the injecting means and the passage through which the projectile is accelerated, the power increase energizing the plasma so plasma initially injected through the injecting means into the fluid mixes with the fluid to cool the plasma and heat the fluid, plasma subsequently injected into the fluid heating the fluid sufficiently so a constituent of the fluid has a highly energetic gaseous state sufficient to accelerate the projectile in the projectile receiving passage.

22. Apparatus for accelerating a projectile in a passage adapted to receive the projectile by applying a high pressure gas to the rear of the projectile while the projectile is in the passage, the gas having sufficient pressure to accelerate the projectile along the passage longitudinal axis toward an open end of the passage, the apparatus comprising a plasma source for generating a plasma having a flow path toward the rear of the projectile, the plasma source including an electric pulse source connected to energize the plasma, the plasma source including a passage having a dielectric wall with an ionizable substance and a pair of electrodes spaced longitudinally from each other along the length of the passage, the electric source having a predetermined wave shape and duration for applying a discharge voltage to the electrodes to establish a discharge in the passage and for thereafter applying to the plasma current that increases as a function of time to cause additional propelling gas to be applied to the rear of the projectile while the projectile is being accelerated through the projectile receiving passage, the increasing current applying increasing power to the plasma between the electrodes, the power increase occurring for at least half the time while the plasma is between the electrodes to energize the plasma so that pressure acting on the rear of the projectile resulting from the increasing power applied between the electrodes to the plasma does not decrease substantially while the projectile is being accelerated by the gas in the passage, the means for increasing including means for increasing the power applied to the plasma between said electrodes in an approximately linear manner with time as the projectile is accelerated by the gas in the passage.

23. The apparatus of claim 22 wherein the means for increasing includes pulse forming means responsive to a DC source.

24. Apparatus for accelerating a projectile in a passage adapted to receive the projectile by applying a high pressure gas to the rear of the projectile while the projectile is in the passage, the gas having sufficient pressure to accelerate the projectile along the passage longitudinal axis toward an open end of the passage, the apparatus comprising a plasma source for generating a plasma having a flow path toward the rear of the projectile, and means for applying increasing power to the plasma throughout a region between a pair of fixed points longitudinally spaced from each other along the plasma flow path in transverse cross-sections of the plasma flow path, the power increase occurring for at least half the time while the plasma is between the points to energize the plasma so that pressure acting on the rear of the projectile resulting from the increasing power applied between the points to the plasma does not decrease substantially while the projectile is being accelerated by the gas in the passage, the plasma source comprising means for forming a capillary passage having a dielectric wall with an ionizable substance, the means for increasing including a pair of electrodes and a variable current source connected to said electrodes, one of said electrodes being connected to the dielectric wall at each of said points, the variable current source supplying a current that increases as a function of time to the electrodes.

25. The apparatus of claim 24 wherein the capillary passage has a longitudinal axis aligned with the passage along which the projectile is accelerated, the capillary passage having a nozzle at one end for injecting the plasma with an axial component into the passage along which the projectile is accelerated to a position behind an initial rest position of the projectile.

26. The apparatus of claim 24 wherein the current source includes means for increasing the current applied to the electrodes while the projectile is being accelerated to maintain the pressure behind the projectile in the passage through which the projectile is accelerated substantially constant while projectile is being accelerated by the gas.

27. The apparatus of claim 24 wherein the current source includes means for increasing the current applied to the electrodes as a function of time to cause the power applied to the plasma between the electrodes to increase as a substantially linear function of time while the projectile is being accelerated by the gas.

28. Apparatus for accelerating a projectile comprising a plasma source, the plasma source including means for forming a capillary passage having a dielectric wall with an ionizable substance, means for establishing a discharge current between two, fixed spaced points along the capillary passage, the discharge current interacting with the ionizable substance to form a plasma and a gas having sufficient pressure to accelerate the projectile in a passage in which the projectile is located, the means for establishing including means for increasing the current as a function of time throughout the length of the capillary passage between the points for at least half of the time while the plasma is derived between the points so that the current applied to the plasma after initial projectile acceleration has progressively larger values as time progresses, and means for supplying the gas to the projectile while the projectile is in the passage through which the projectile is accelerated to accelerate the projectile.

29. The apparatus of claim 28 further including a barrel downstream of the capillary passage in which the projectile is initially positioned, the barrel having a bore positioned to be responsive to the gas derived from the interaction of the current and the ionizable substance, the bore being the passage through which the projectile is accelerated.

30. The apparatus of claim 29 further including a confined mass of projectile propelling fluid positioned between the ionizable substance of the plasma source and a location behind the projectile in the passage in which the projectile is accelerated, the confined mass of propelling fluid interacting with the plasma injected into the fluid to cool the plasma and heat the fluid, the plasma heating the fluid sufficiently so a constituent of the fluid has a highly energetic gaseous state sufficient to accelerate the projectile in the passage in which the projectile is accelerated.

31. The apparatus of claim 30 wherein the confined mass of fluid is downstream of an outlet of the plasma source.

32. Apparatus for accelerating a projectile comprising a plasma source, the plasma source including means for forming a capillary passage having a dielectric wall with an ionizable substance, means for establishing a discharge current between two, fixed spaced points along the capillary passage, the discharge current interacting with the ionizable substance to form a plasma and a gas having sufficient pressure to accelerate the projectile in a passage in which the projectile is located, the means for establishing including means for substantially increasing the current throughout the length of the capillary passage between the points for at least half the time while the plasma is derived between the points, the square of the current established between the two fixed points increasing approximately linearly with time, and means for supplying the gas to the projectile while the projectile is in the passage through which the projectile is accelerated to accelerate the projectile.

33. A method of accelerating a projectile comprising the steps of applying a discharge current to an ionizable substance on a dielectric wall of a capillary passage via a pair of electrodes longitudinally spaced from each other along the passage, the discharge current forming a plasma in the capillary as a result of an interaction between the current and the substance, substantially increasing the current for most of the time while the plasma is derived between the electrodes so that the current applied to the plasma after initial projectile acceleration has progressively larger values as time progresses, the plasma establishing a high pressure gas having sufficient pressure behind the projectile to accelerate the projectile, and applying the high pressure gas to the rear of the projectile to accelerate the projectile.

34. A method of accelerating a projectile comprising the steps of applying a discharge current to an ionizable substance on a dielectric wall of a capillary passage via a pair of electrodes longitudinally spaced from each other along the passage, the discharge current forming a plasma in the capillary as a result of an interaction between the current and the substance, substantially increasing the current between the electrodes for at least half the time while the plasma is derived such that the square of the current increases approximately linearly, the plasma establishing a high pressure gas having sufficient pressure behind the projectile to accelerate the projectile, and applying the high pressure gas to the rear of the projectile to accelerate the projectile.

35. The method of claim 34 further including the step of applying the plasma in the capillary passage to a confined mass of fluid located between the ionizable substance and a passage in which the projectile is accelerated, the plasma mixing with the fluid to cool the plasma and heat the fluid so a constituent of the fluid has a highly energetic gaseous state sufficient to accelerate the projectile in the passage in which the projectile is accelerated, and applying the highly energetic gaseous constituent of the fluid to the rear of the projectile to accelerate the projectile in the passage in which the projectile is located.

36. A method of accelerating a projectile in a barrel bore comprising the steps of forming a pulsed plasma in a capillary passage having a pair of electrodes longitudinally spaced from each other in the passage, applying the pulsed plasma formed in the capillary passage to a projectile propelling mass located in a flow path between the passage and the bore, the mass and plasma interacting so the mass is heated by the plasma, constituents of the mass being sufficiently heated by the plasma to become mixed with the plasma to form a high pressure mixture, the mixture having sufficient pressure to accelerate the projectile in the bore, applying the high pressure mixture to the bore against the rear of the projectile so that the mixture flows longitudinally along the bore axis to accelerate the projectile along the bore axis, dragging the mass into the plasma so that the mixture does not cause substantial damage to the bore wall, and progressively increasing the power applied to the electrodes in the capillary passage while the projectile is being accelerated, the progressively increasing power being applied to the plasma via the electrodes.

37. The method of claim 36 wherein the constituent is hydrogen.

38. A method of accelerating a projectile in a barrel bore comprising the steps of forming a plasma jet in a capillary passage, applying the plasma jet formed in the capillary passage to a projectile propelling fluid located between the passage and the bore, the fluid and jet interacting so the fluid is heated by the jet, constituents of the fluid being sufficiently heated by the jet to become mixed with the plasma to form a high pressure mixture, the mixture having sufficient pressure to accelerate the projectile in the bore, applying the high pressure mixture to the bore against the rear of the projectile so that the mixture flows longitudinally along the bore axis to accelerate the projectile along the bore axis, dragging the fluid into the plasma so that the mixture does not cause substantially damage to the bore wall, and controlling the plasma jet so there is no substantial decrease in the pressure of the mixture acting on the rear of the projectile while the projectile is being accelerated by the mixture in the bore to increase the speed of the projectile as time progresses, the pressure being maintained substantially constant by increasing the power applied to the plasma by way of a pair of electrodes in the capillary passage by approximately linearly increasing the square of current fed to the pair of electrodes as a function of time while the projectile is accelerated in the bore.

39. A method of accelerating a projectile in a barrel bore comprising the steps of forming a pulsed plasma in a capillary passage by applying an electric pulse to a pair of electrodes spaced longitudinally from each other along the length of a capillary passage having a dielectric wall with an ionizable substance, applying the pulsed plasma formed in the capillary passage to a projectile propelling mass located between the passage and the bore, the mass and plasma interacting so the mass is heated by the plasma, constituents of the mass being sufficiently heated by the plasma to become mixed with the plasma to form a high pressure mixture, the mixture having sufficient pressure to accelerate the projectile in the bore, applying the high pressure mixture to the bore against the rear of the projectile so that the mixture flows longitudinally along the bore axis to accelerate the projectile along the bore axis, dragging the mass into the plasma so that the mixture does not cause substantial damage to the bore wall, and controlling the plasma to mix with the constituents by progressively increasing the current and power applied to the plasma between the electrodes while the projectile is in the bore and is being accelerated.

40. In combination, means forming an elongated passage, means for establishing a directed plasma flowing longitudinally through the elongated passage, and means for applying increasing power to the plasma throughout a region between a pair of fixed points longitudinally spaced from each other along the plasma flow path in the elongated passage in transverse cross-sections of the plasma flow path, the power increase occurring for at least half the time while the plasma is between the points, the means for establishing including means for forming a capillary passage having a dielectric wall with an ionizable substance, the means for applying including a pair of electrodes and a variable current source connected to said electrodes, one of said electrodes being connected to the dielectric wall at each of said points, the variable current source supplying a current that increases as a function of time to the electrodes, wherein the means for increasing includes means for increasing the power applied to the plasma between said fixed points in an approximately linear manner with time.

41. In combination, means forming an elongated passage, means for establishing a plasma in the elongated passage, and means for applying increasing power to the plasma throughout a region between a pair of fixed points longitudinally spaced from each other in the plasma in the elongated passage in transverse cross-sections between the fixed points, the power increase occurring for at least half the time while the plasma is between the points, the means for establishing including means for forming a capillary passage having a dielectric wall with an ionizable substance, the means for applying including a pair of electrodes and a variable current source connected to said electrodes, one of said electrodes being connected to the dielectric wall at each of said points, the variable current source supplying a current that increases as a function of time to the electrodes.

42. The combination of claim 41 wherein the variable current source includes means for applying a current having a squared value that increases approximately linearly as a function of time for approximately the entire time while the plasma is between the points.

43. In combination, means forming an elongated passage having a dielectric wall with an ionizable substance, a pair of electrodes spaced longitudinally from each other along the length of the passage, an electric pulse source connected to said electrodes for establishing a directed plasma flowing longitudinally through the elongated passage, the electric pulse source applying increasing current and power to the electrodes and the plasma between the electrodes, the current and power increase occurring for at least half the time while the plasma is between the points, the power applied to the plasma between the electrodes increasing approximately linearly.

44. Apparatus for accelerating a projectile through a bore of a barrel for receiving the projectile comprising a plasma source for forming a high pressure propelling gas in a chamber behind the projectile so that the propelling gas accelerates the projectile in the bore, an electric pulse source connected to energize the plasma, the plasma source including a passage having a dielectric wall with an ionizable substance and a pair of electrodes spaced longitudinally from each other along the length of the passage, the electric source having a predetermined wave shape and duration for applying a discharge voltage to the electrodes to establish a discharge in the passage and for thereafter applying to the plasma current that increases as a function of time to cause additional propelling gas to be applied to the rear of the projectile while the projectile is being accelerated through the projectile receiving passage.

45. Apparatus for accelerating a projectile through a bore of a barrel for receiving the projectile comprising a plasma source for forming a high pressure propelling gas in a chamber behind the projectile so that the propelling gas accelerated the projectile in the bore, an electric pulse source connected to energize the plasma, the plasma source including a passage having a dielectric wall with an ionizable substance and a pair of electrodes spaced longitudinally from each other along the length of the passage, the electric source having a predetermined wave shape and duration for applying a discharge voltage to the electrodes to establish a discharge in the passage to (a) initially form the plasma in the passage without moving the projectile, and (b) thereafter apply to the plasma current that increases as a function of time to cause additional propelling gas to be applied to the rear of the projectile while the projectile is being accelerated through the projectile receiving bore.

46. The apparatus of claim 45 wherein the applied current increases monotonically.

47. The apparatus of claim 46 wherein the electric pulse source includes means for deriving a wave shape such that the square of the current applied by the electric pulse source to the plasma by the electrodes increases approximately linearly as the elapsed time of the wave shape increases.

48. The apparatus of claim 47 wherein the electric pulse source includes means for deriving a wave shape such that the square of the current applied by the electric pulse source to the plasma increases approximately linearly as the elapsed time of the wave shape increases.

* * * * *